US006665887B2

(12) United States Patent
Nguyen

(10) Patent No.: US 6,665,887 B2
(45) Date of Patent: Dec. 23, 2003

(54) PORTABLE SPITTOON

(76) Inventor: Nhan S. Nguyen, 891 Brompton Ct., Newport News, VA (US) 23608

( * ) Notice: Subject to any disclaimer, the term of this patent is extended or adjusted under 35 U.S.C. 154(b) by 0 days.

(21) Appl. No.: 10/344,355

(22) PCT Filed: Aug. 10, 2001

(86) PCT No.: PCT/US01/25230

§ 371 (c)(1),
(2), (4) Date: Feb. 10, 2003

(87) PCT Pub. No.: WO02/13757

PCT Pub. Date: Feb. 21, 2002

(65) Prior Publication Data

US 2003/0204901 A1 Nov. 6, 2003

Related U.S. Application Data

(60) Provisional application No. 60/224,474, filed on Aug. 10, 2000.

(51) Int. Cl.[7] ..... A61J 19/00

(52) U.S. Cl. ..... 4/258

(58) Field of Search ..... 4/258, 259, 267, 4/271, 282, 283

(56) References Cited

U.S. PATENT DOCUMENTS

| | | | |
|---|---|---|---|
| 630,225 | A | 8/1899 | Hodgerney |
| 1,012,471 | A | 12/1911 | Steinke |
| 2,965,907 | A | 12/1960 | Ropelato |
| 3,798,682 | A | 3/1974 | Harreld |
| 4,162,547 | A | 7/1979 | Jenkins |
| 4,628,547 | A | 12/1986 | Baker |

*Primary Examiner*—Charles E. Phillips
(74) *Attorney, Agent, or Firm*—Kimberly A. Chasteen, Esq.

(57) ABSTRACT

A portable spittoon is a sanitary, discrete method for disposing of tobacco juice or other secretions. The spittoon includes a container (26) and a lid (14). The lid (14) includes an opening (30) into which the secretions are placed and a funnel portion (32) for transferring the secretions into the container (26) when actuated and sealing the funnel when not actuated. The seal and funnel design act to minimize the risk of spillage from the container. The container can further include a window (28) such that the user can monitor the contents of the container.

15 Claims, 4 Drawing Sheets

PORTABLE SPITTOON

CROSS REFERENCE TO RELATED APPLICATION

The present application claims priority from U.S. Provisional Application Ser. No. 60/224,474, filed Aug. 10, 2000.

BACKGROUND OF THE INVENTION

1. Field of the Invention

The present invention relates to portable spittoons. In particular, the present invention relates to portable spittoons which are pocket-sized and which prevent spillage of the contents.

2. Description of the Related Art

Persons who chew tobacco or use snuff often find difficulty in chewing or using tobacco because it is often inconvenient to dispose of the related tobacco juices and other secretions. This inconvenience is particularly prevalent in public places.

Portable spittoons have been previously invented to reduce this inconvenience. Although these previously developed portable spittoons have been designed in various shapes and sizes, they have not been practical, spill-proof or easy to use. In fact they have been unsatisfactory in terms of size, performance, convenience, spillage, method of operation and cost. One very important shortcoming of previously developed portable spittoons is that they have often been too complicated and have involved many moving parts which has naturally made them being quite expensive. Moreover, many types of spittoons previously used have simply been very difficult to use in a sanitary manner and have not satisfactorily prevented spillage.

U.S. Pat. No. 4,628,547 shows a portable spittoon which attempts to overcome many of the deficiencies of the prior art. This spittoon is awkward to use due to the small mouthpiece, the mechanism for reducing spillage is not satisfactory and the small pieces are difficult to clean.

U.S. Pat. No. 4,162,547 shows a pocket cuspidor which uses multiple containers and is very complex. This device cannot be used discreetly.

U.S. Pat. No. 3,798,682 shows a portable cuspidor consisting of a cup inside a container with a hinged lid. While the device is simple, it is not easy to use and is not sufficiently spill-proof.

U.S. Pat. No. 2,965,907 shows a portable cuspidor which uses suction to collect secretions. The device is very complex and contains many difficult to clean elements.

U.S. Pat. No. 1,012,471 shows a portable spittoon. As this device was created to prevent the spread of infectious diseases, its construction is complex and aimed at preventing the escape of the contents making it difficult to use.

U.S. Pat. No. 630,225 shows a pocket cuspidor which remains in the user's pocket. A telescoping tube is used to transport secretions into the cuspidor.

Therefore, there has been and continues to be a need for an easy-to-use, spill-proof, practical and portable spittoon that can be easily and conveniently carried and used by an individual who chooses to use nonsmoking tobacco.

SUMMARY OF THE DISCLOSURE

A portable spittoon is described which includes a container for collecting secretions from a user's mouth having a bottom, side walls and an open top. If necessary, a side wall of the container can incorporate a window for monitoring the contents of the container. A lid, which has a top surface, side walls and an open bottom, is removably mounted to the open top of the container. In order to transfer secretions from the user's mouth into the container, there is an opening in the side wall of the lid. The open bottom of the lid has a funnel-shaped portion which leads into the container. The funnel-shaped portion is temporarily sealed by an element, such as a flexible seal, which is movable by use of an actuator between a closed position and an open position. If desired, the seal can be adjustable so that a tight seal can be maintained when the seal is in the closed position. The actuator for the seal can include an actuating rod to which the seal is connected such that when the rod is moved, the seal moves between the closed position and the open position. A spring can be used to force the seal into the closed position when the spring is in its uncompressed state. A lockable valve button can be connected to the upper end of the actuating rod for moving the actuating rod which, in turn, moves the seal between the closed position and the open position. To obtain a leak-tight connection between the seal and the funnel-shaped portion of the lid, the actuating rod should extend through the center of the lid and the seal such that the seal is pulled against the funnel-shaped portion with equal pressure about its edge.

It is therefore an object of the present invention to provide a portable spittoon.

It is another object of the present invention to provide a portable spittoon which is spill-proof.

It is yet another object of the present invention to provide a portable spittoon which is convenient and easy to use.

It is yet a further object of the present invention to provide a portable spittoon which has a simple design which is easy to clean and can be repaired by the user.

Finally, it is an object of the present invention to accomplish the foregoing objectives in a simple and cost effective manner.

DETAILED DESCRIPTION OF TE PREFERRED EMBODIMENT

The following detailed description is of the best presently contemplated modes of carrying out the invention. This description is not to be taken in a limiting sense, but is made merely for the purpose of illustrating general principles of embodiments of the invention.

The present invention provides a portable spittoon which is small, prevents spillage and can be used discreetly. The device includes a container portion in which secretions are stored The container has an open top which can be covered by a lid portion. The lid portion includes an opening in the sidewall for accepting secretions, a funnel-shaped lower section for directing the secretions into the container portion and an actuator for opening and closing a seal. The device further includes a system for preventing spillage of the container contents. The seal is situated on a rod at the bottom of the funnel-shaped section and controls access to the container.

A preferred embodiment of the portable spittoon is shown in FIGS. 1–4. A container 26 having an open top is provided. In a particularly preferred embodiment, the container 26 includes a window 28 so that the user can monitor the contents of the container 26. A lid 14 is connected to the container 26 by any liquid tight means. In the embodiment shown, the internal surface of the lid 14 is threaded to mate with threads on the external surface of the container 26. To facilitate use, quick disconnect threads can be used to allow the lid 14 to be removed from the container 26 with a slight twist, for example, a half turn. This enables easy disposal of the contents and allows the user to dispose of large, other-than-liquid secretions such as spent tobacco. To further protect against spillage, an O-ring or gasket can be used to seal the connection between the lid 14 and the container 26. The lid 14 includes an opening 30 into which secretions are deposited by the user. As shown, the opening 30 should be large enough to enable easy access for the disposal of liquid and other small debris. In a particularly preferred embodiment, the opening 30 includes a ledge which can be used to direct spare drops into the container 26 from the user's mouth.

Figure 1:
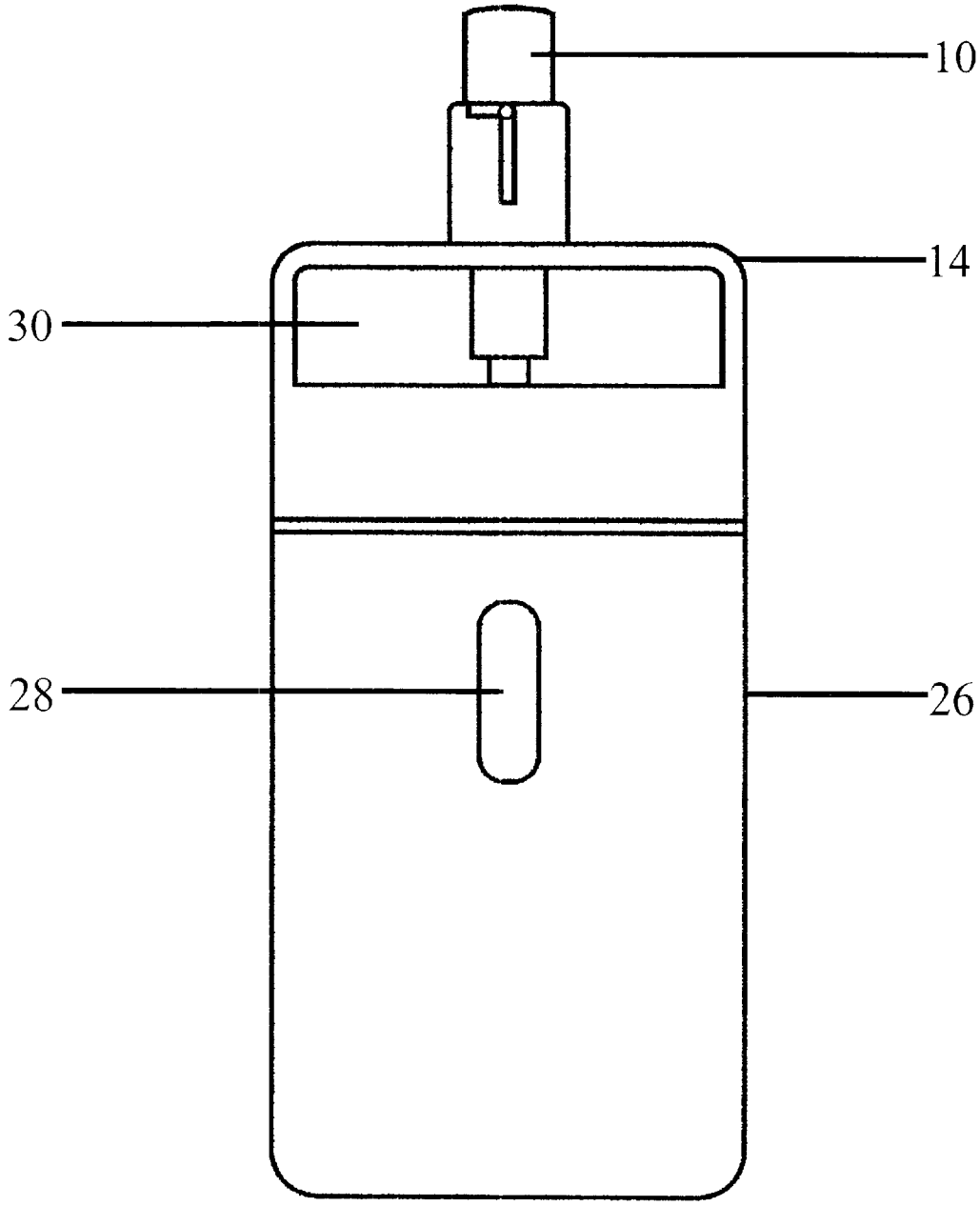
FIG. 1 is a perspective view of the preferred embodiment of the present invention.
Figure 2:
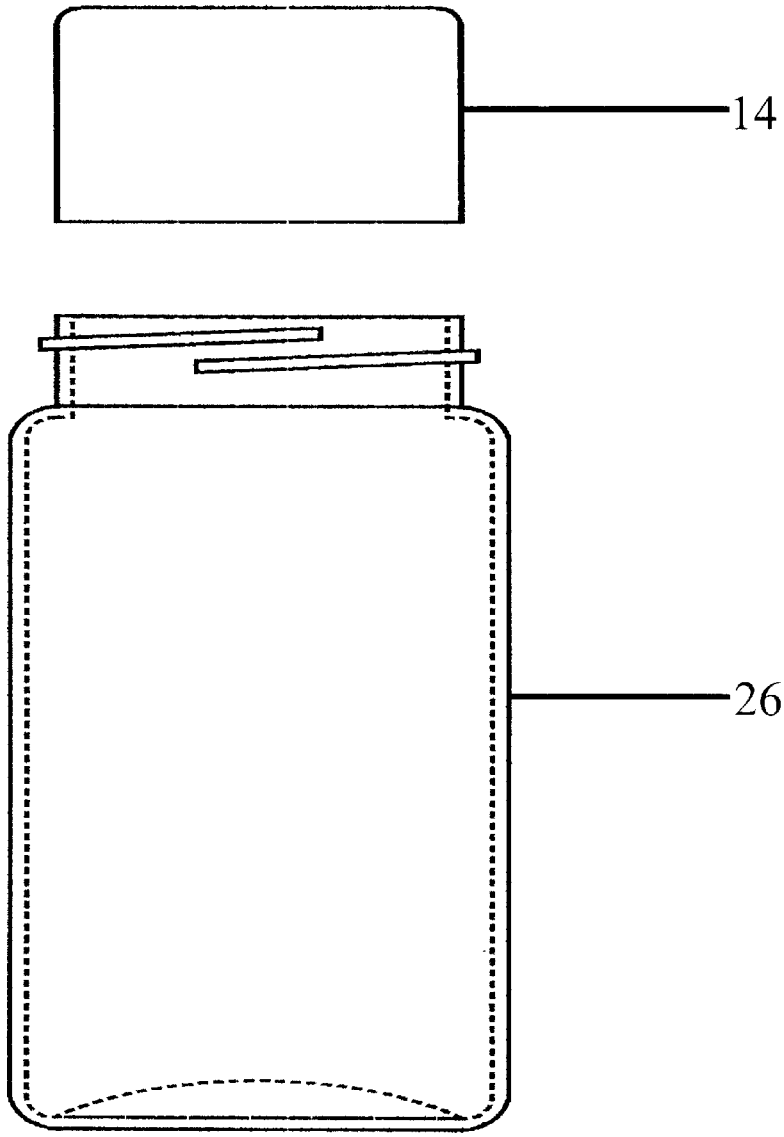
FIG. 2 is an exploded view of the two major elements of the preferred embodiment of the present invention.
Figure 3:
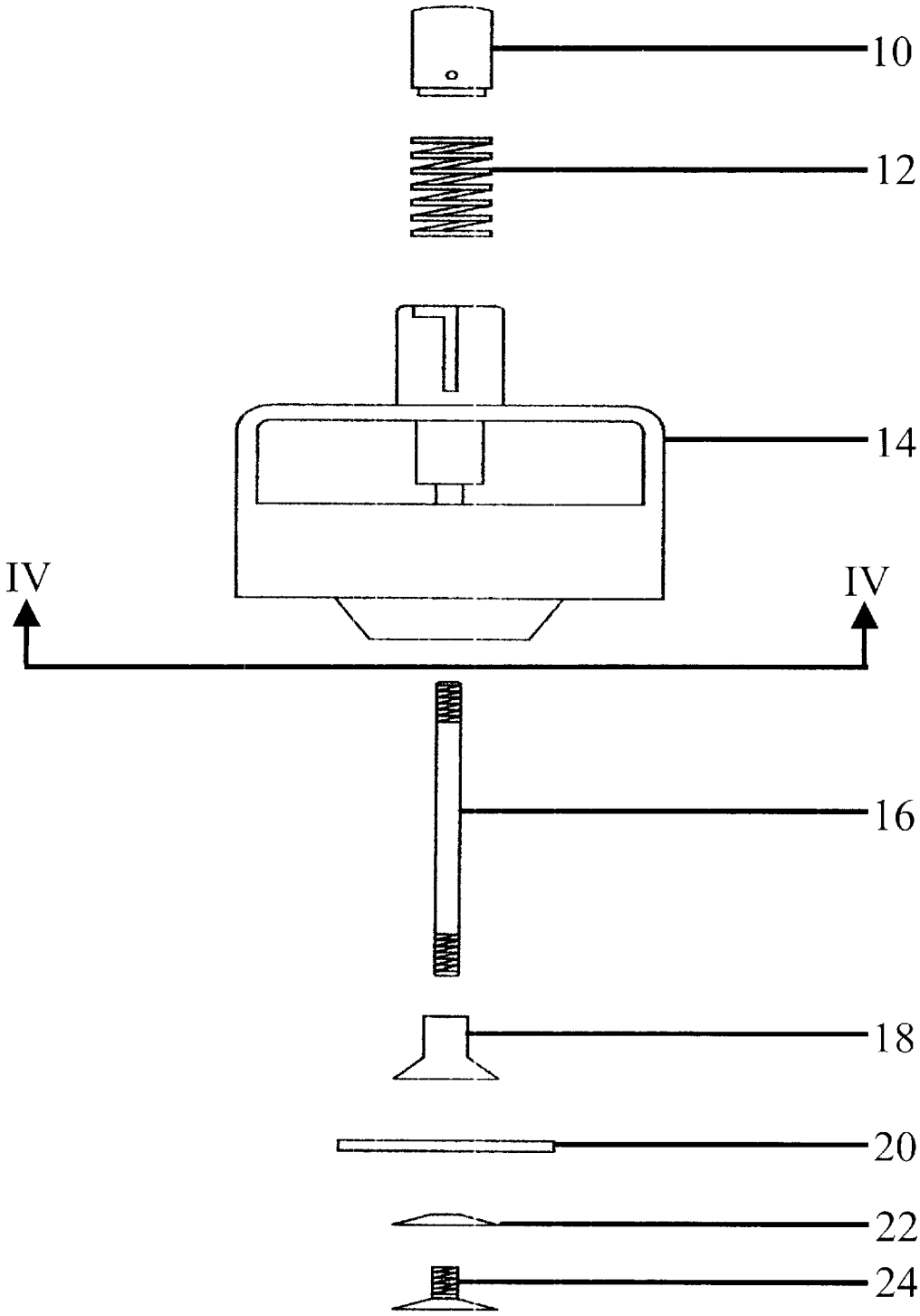
FIG. 3 is an exploded view of the lid and actuating means of the preferred embodiment of the present invention.
Figure 4:
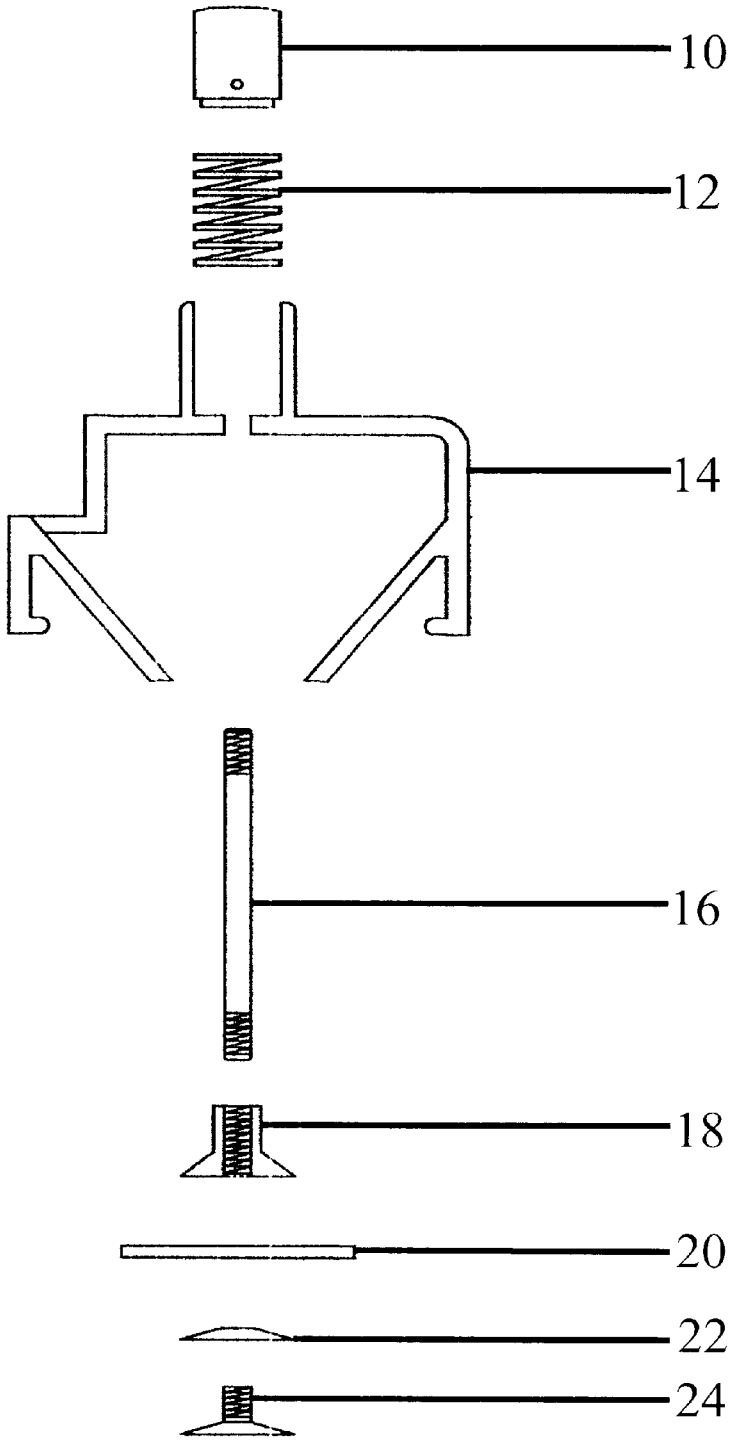
FIG. 4 is an exploded view of the lid and actuating means of the preferred embodiment of the present invention with the lid shown in cross section along line IV—IV of FIG. 3.

A critical characteristic of the portable spittoon described herein is that it prevents spillage of the contents. FIGS. 3 and 4 show the elements which function to prevent spillage in detail. A valve button 10 rests on a spring 12 which is seated in the lid 14. One end of a pushing rod 16 extends through the lid 14 and the spring 12 to screw into the valve button 10. The opposite end of the pushing rod 16 screws into the upper end of a seal nut 18. A seal 20 is attached to the seal nut 18 by means of a screw 24 and a washer 22. The seal 20 is preferably made from flexible rubber although other appropriate materials may be used. The screw 24 screws into the lower end of the seal nut 18, thus maintaining the seal 20 in close contact with the seal nut 18. In the preferred embodiment, the pushing rod 16 extends through the center of the lid 14 and the container 26 such that the seal contacts the narrow diameter portion of the funnel section 32 evenly about its perimeter in the resting position.

The design of the lid 14 further aids in preventing spillage. As shown in FIG. 4, the lower portion of the lid 14 includes a funnel-shaped section 32. This funnel shaped section 32 directs secretions into the container 26. Additionally, because the funnel-shaped section 32 acts to narrow the potential exit path of the secretions should the container 26 spill and the seal 20 fail, the possibility of the contents escaping is further minimized.

All of the elements of the invention are preferably made from lightweight, durable materials such as plastic or aluminum. The portable spittoon is preferably constructed in a size which would fit into a user's pocket in order to be particularly convenient to use. The portable spittoon may also be carried on a belt and its spill-proof design even allows transport in a purse or other bag. If desired for sanitary or ease of use reasons, the container or the container and lid can be made from disposable materials.

In use, when the tobacco chewer wishes to spit into the portable spittoon, the valve button 10 is depressed, compressing the spring 12. This forces the pushing rod 16 down which further forces the seal 20 away from the lid 14. This causes a passageway to be formed between the opening 30 in the side of the lid 14 and the container 26 through which small amounts of spent tobacco or other secretions may be spit. When the tobacco chewer is finished spitting, the valve button 10 is released. The. spring 12 forces the pushing rod 16 back up which also forces the seal 20 to abut tightly and with even force about its perimeter against the lid 14. This seal 20 prevents the contents of the canister from spilling.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A portable spittoon comprising:

a container including a bottom, side walls and an open top;

a lid removably mounted to the open top of said container, the lid having a top surface, side walls and an open bottom; the open bottom including a funnel-shaped portion having an opening leading into the container;

means for transferring secretions from a user's mouth into the container;

a sealing means being movable between a closed position and an open position with respect to the funnel-shaped portion;

an actuating means operatively connected with the seal for moving the seal from the closed position to the open position, wherein the actuating means includes a locking means for temporarily disabling the actuating means such that the sealing means remains in the closed position.

2. A portable spittoon as set forth in claim 1 wherein the means for transferring secretions from a user's mouth into said container is an opening in a side wall of the lid.

3. A portable spittoon as set forth in claim 1 wherein the sealing means is a flexible seal.

4. A portable spittoon as set forth in claim 1 wherein the sealing means is adjustable such that constant contact with the funnel-shaped portion can be maintained in the closed position.

5. A portable spittoon as set forth in claim 1 wherein the actuating means includes an actuating rod to which the sealing means is connected such that the actuating rod moves the sealing means from the closed position to the open position when actuated.

6. A portable spittoon as set forth in claim 5 wherein the actuating means further includes a spring means for forcing the sealing means back into the closed position when the actuating rod is not actuated.

7. A portable spittoon device as set forth in claim 5 wherein the actuating rod extends through the lid and a valve button is connected to the portion of the actuating rod extending through the lid such that the sealing means moves from the closed position to the open position when the valve button is actuated.

8. A portable spittoon as set forth in claim 6 wherein the actuating rod extends through the lid and a valve button is connected to the portion of the actuating rod extending through the lid such that the sealing means moves from the closed position to the open position when the valve button is actuated and such that the spring means forces the sealing means into the closed position when the valve button is not actuated.

9. A portable spittoon as set forth in claim 5 wherein the rod extends through the center of the lid.

10. A portable spittoon as set forth in claim 5 wherein the rod extends through the center of the lid, such that the perimeter of the sealing means is in constant, equally distributed contact with the funnel-shaped portion.

11. A portable spittoon as set forth in claim 1 wherein the container further includes a means for monitoring the status of the container.

12. A portable spittoon as set forth in claim 11 wherein the means for monitoring the status of the container is a window constructed in the side wall of the container.

13. A portable spittoon comprising:

a container including a bottom, side walls and an open top;

a lid removably mounted to the open top of said container, the lid having a top surface, side walls and an open bottom; the open bottom including a funnel-shaped portion having an opening leading into the container;

means for transferring secretions directly from a user's mouth into said container consisting of an opening in a side wall of the lid;

a flexible seal being movable between a closed position and an open position with respect to the funnel-shaped portion;

an actuating means comprising:

an actuating rod which extends through the lid and to which the flexible seal is operatively connected;

a valve button which is connected to the portion of the rod extending through the lid such that the sealing means moves from the closed position to the open position when the valve button is actuated;

a spring for forcing the flexible seal back into the closed position when the rod is not actuated; and a locking means for temporarily disabling the actuating means such that the sealing means remains in the closed position.

14. A portable spittoon comprising:

a container including a bottom, side walls and an open top;

a lid removably mounted to the open top of said container, the lid having a top surface, side walls and an open bottom; the open bottom including a funnel-shaped portion having an opening leading into the container;

means for transferring secretions directly from a user's mouth into said container consisting of an opening in a side wall of the lid;

a flexible seal being movable between a closed position and an open position with respect to the funnel-shaped portion;

an actuating means comprising:

an actuating rod which extends through the lid and to which the flexible seal is operatively connected;

a valve button which is connected to the portion of the rod extending through the lid such that the sealing means moves from the closed position to the open position when the valve button is actuated;

a spring for forcing the flexible seal back into the closed position when the rod is not actuated; and a locking means for temporarily disabling the actuating means such that the sealing means remains in the closed position.

15. A portable spittoon comprising:

a container including a bottom, side walls and an open top and having a window constructed in the side wall of the container;

a lid removably mounted to the open top of said container, the lid having a top surface, side walls and an open bottom; the open bottom including a funnel-shaped portion having an opening leading into the container;

means for transferring secretions directly from a user's mouth into the container;

a sealing means being movable between a closed position and an open position with respect to the funnel-shaped portion;

an actuating means operatively connected with the seal for moving the seal from the closed position to the open position, wherein the actuating means includes a locking means for temporarily disabling the actuating means such that the sealing means remains in the closed position.

* * * * *